US006846152B2

(12) United States Patent
Mikrut et al.

(10) Patent No.: US 6,846,152 B2
(45) Date of Patent: Jan. 25, 2005

(54) OVERSHOT LOADER FOR AUTONOMOUS OPERATION

(75) Inventors: Daniel L. Mikrut, Chillicothe, IL (US); Charles J. Chappell, Chillicothe, IL (US); Ronald O. Groth, Metamora, IL (US); Eldon D. Oestmann, Morton, IL (US); Noel J. Rytter, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 10/308,742

(22) Filed: Dec. 3, 2002

(65) Prior Publication Data

US 2004/0105747 A1 Jun. 3, 2004

(51) Int. Cl.[7] ..... E02F 5/00
(52) U.S. Cl. ..... 414/700; 414/685
(58) Field of Search ..... 414/697, 700, 414/706–715, 685

(56) References Cited

U.S. PATENT DOCUMENTS

| | | | | |
|---|---|---|---|---|
| 2,182,781 A | | 12/1939 | Andersen et al. | |
| 2,227,624 A | | 1/1941 | Benbow et al. | |
| 2,296,827 A | | 9/1942 | Andersen et al. | |
| 2,316,760 A | | 4/1943 | Andersen et al. | |
| 2,334,835 A | | 11/1943 | Nix | |
| 2,427,968 A | | 9/1947 | Hoover | |
| 2,518,096 A | | 8/1950 | Thorne | |
| 2,529,338 A | | 11/1950 | Hoover | |
| 2,715,472 A | | 8/1955 | McEwen | |
| 2,764,302 A | | 9/1956 | Webb | |
| 2,777,589 A | | 1/1957 | Studle et al. | |
| 2,799,410 A | | 7/1957 | Carlson | |
| 2,833,360 A | | 5/1958 | Spanjer | |
| 2,879,908 A | | 3/1959 | Andersen | |
| 2,936,086 A | | 5/1960 | Pueschner et al. | |
| 3,090,511 A | | 5/1963 | Denham | |
| 3,203,564 A | | 8/1965 | Breckelbaum et al. | |
| 3,443,704 A | | 5/1969 | Eriksson | |
| 3,522,898 A | * | 8/1970 | Rotheisler | 414/709 |
| 3,876,101 A | | 4/1975 | Stedman | |
| 5,413,454 A | * | 5/1995 | Movsesian | 901/1 X |
| 5,941,921 A | | 8/1999 | Dasys et al. | |
| 5,993,139 A | * | 11/1999 | Deneve et al. | 414/697 X |
| 6,514,031 B1 | * | 2/2003 | Cook | 414/685 |

* cited by examiner

*Primary Examiner*—Donald W. Underwood
(74) *Attorney, Agent, or Firm*—Steven D Lundquist

(57) ABSTRACT

An overshot loader including a set of ground engaging members, a frame attached to the set of ground engaging members, and a linkage assembly movably connected to the frame and located within a longitudinal center portion of the frame.

33 Claims, 7 Drawing Sheets

OVERSHOT LOADER FOR AUTONOMOUS OPERATION

TECHNICAL FIELD

This invention relates generally to an overshot loader and, more particularly, to an overshot loader configured for autonomous operation.

BACKGROUND

Overshot loaders, also known as overhead loaders, differ from conventional loading machines in that a work implement, typically a bucket, loads material from one end of the machine, e.g., the front, lifts the material over the top of the machine, and dumps the material from the other end of the machine, e.g., the rear.

Numerous examples can be found in the patent literature of overshot loaders, particularly during the 1940s, 1950s and 1960s. As a few examples, in U.S. Pat. No. 3,203,564, Brekelbaum et al. disclose a wheel loader which incorporates the overshot concept. Pueschner et al., in U.S. Pat. No. 2,936,086, disclose an overhead loader based on a tracked loading machine. Hoover elaborates on various features of overshot loaders in U.S. Pat. Nos. 2,427,968 and 2,529,338.

Overshot loaders during the above-mentioned period of time required human operators on board the machines. Thus, in virtually all cases, the load of material passing over the top of the machine also passed over the operator. As a consequence, overshot loaders never became popular in spite of the potential increase in productivity resulting from more efficient handling of the material being loaded and dumped. In fact, from the 1970s to the present, patent literature on overshot loaders have virtually disappeared, as well as the use or consideration of use of overshot loaders at all.

Recent advances in technology have made autonomous machines not only feasible, but economically practical and efficient. Features such as position determination, obstacle detection, engine and machine control, and path planning have made the autonomous machine a distinct possibility. A true autonomous machine, if designed with autonomy in mind, does not require the constraints of human interaction. For example, a typical loading machine must have an operator cab and controls. The cab must become a substantial factor in machine design since operator safety and comfort are major parts of design considerations.

An overshot loader designed to operate autonomously, or at most by remote control, may be built without the constraints imposed by manual operation. Placement of the power and drive train, and function of the work linkages and work implement, may be designed for optimal productivity and efficiency. Thus, an overshot loader designed and built for non-manual operation has the potential for productivity rivaling much more expensive and massive machines, such as front shovels and large excavators.

The present invention is directed to overcoming one or more of the problems as set forth above.

SUMMARY OF THE INVENTION

In one aspect of the present invention an overshot loader is disclosed. The overshot loader includes a set of ground engaging members, a frame attached to the set of ground engaging members, and a linkage assembly movably connected to the frame and located within a longitudinal center portion of the frame.

In another aspect of the present invention a linkage assembly for an overshot loader is disclosed. The linkage assembly includes a boom having a first end pivotally connected to a frame and oriented substantially centered with and parallel to a longitudinal center portion of the frame, a stick having a first end pivotally connected to a second end of the boom, and a work implement pivotally connected to a second end of the stick.

In yet another aspect of the present invention an overshot loader is disclosed. The overshot loader includes a set of ground engaging members, a frame attached to the set of ground engaging members, a boom having a first end pivotally connected to the frame and oriented substantially centered with and parallel to a longitudinal center portion of the frame, a stick having a first end pivotally connected to a second end of the boom, a work implement pivotally connected to a second end of the stick, and at least one control link having a first end pivotally connected to the frame and a second end pivotally connected to the stick, wherein the frame defines a ground link of a first four bar linkage, the boom defines a power link of the first four bar linkage, a portion of the stick from a boom-to-stick connection point to a control link-to-stick connection point defines a coupler link of the first four bar linkage, and the control link defines a control link of the first four bar linkage.

DETAILED DESCRIPTION

The following paragraphs and the accompanying drawings and claims describe an overshot loader 100 for autonomous operation. It is noted that autonomous operation refers to unmanned operation; that is, the loader 100 is configured to operate without the direct interaction of a human operator. However, autonomous operation in the present context may also refer to remote operation by a human operator. For example, a human operator may control operations of the loader 100 from a remote location.

Figure 1:
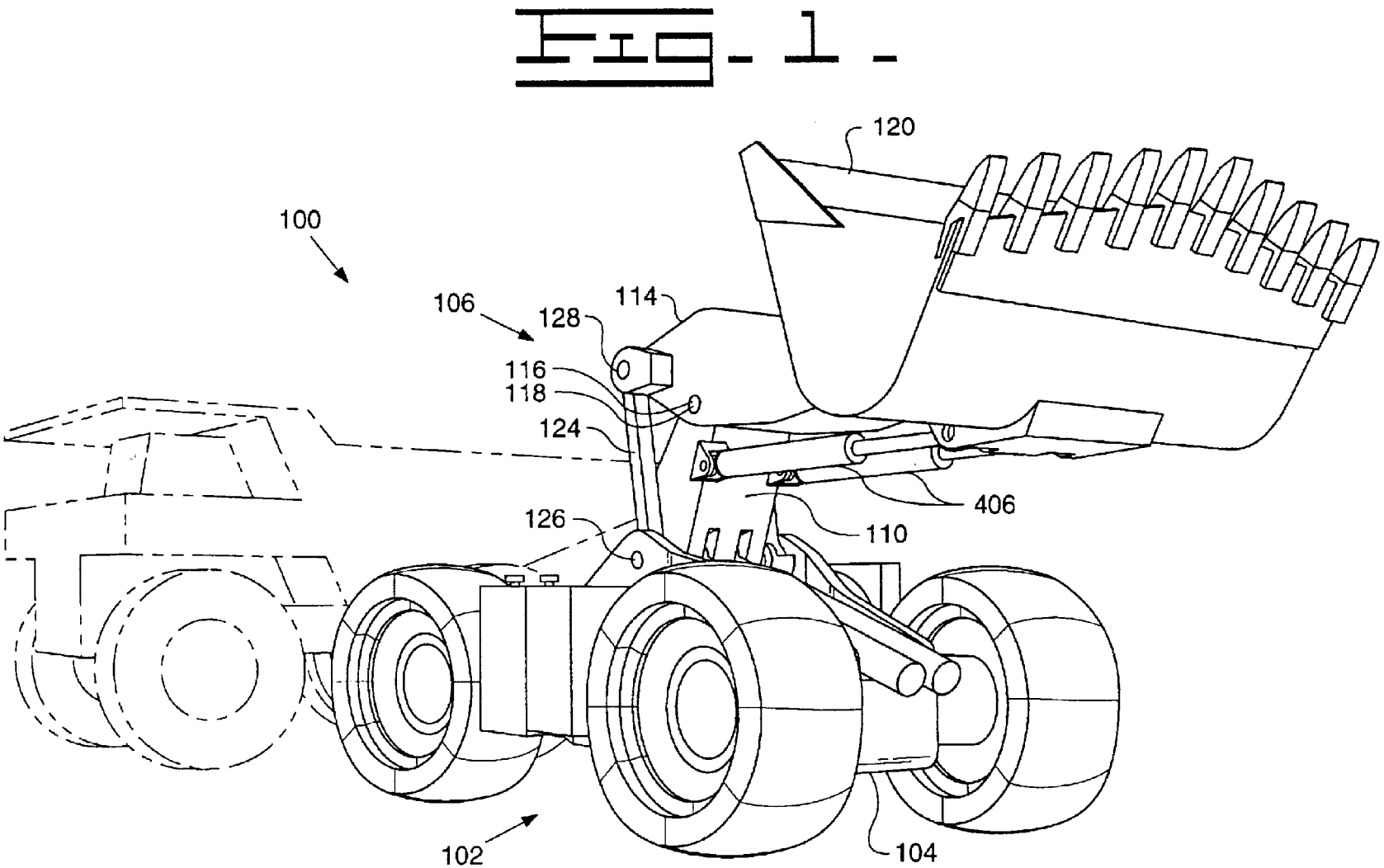
FIG. 1 is a diagrammatic illustration of an overshot loader of the present invention.
Figure 2:
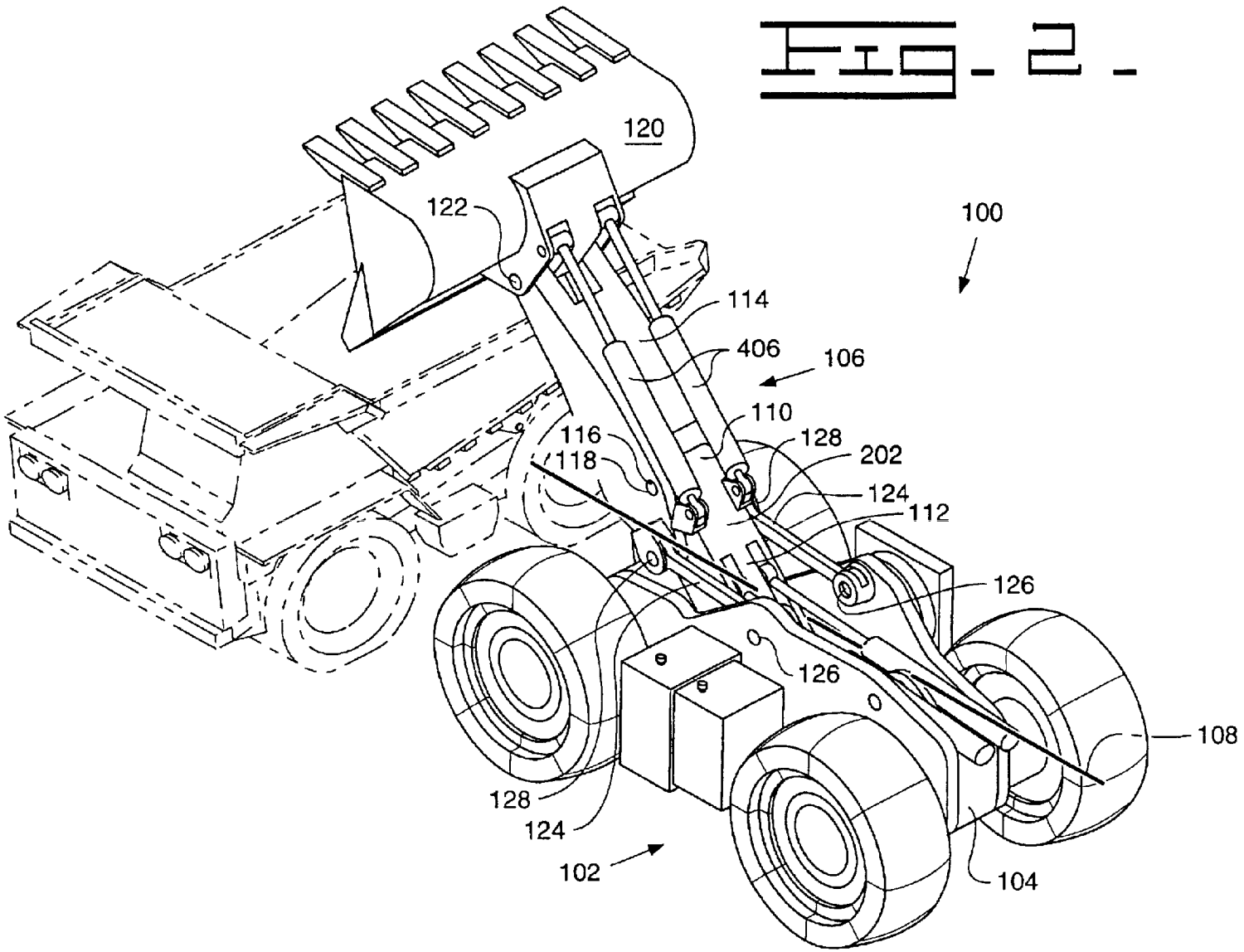
FIG. 2 is another view of the overshot loader of FIG. 1.
Figure 3:
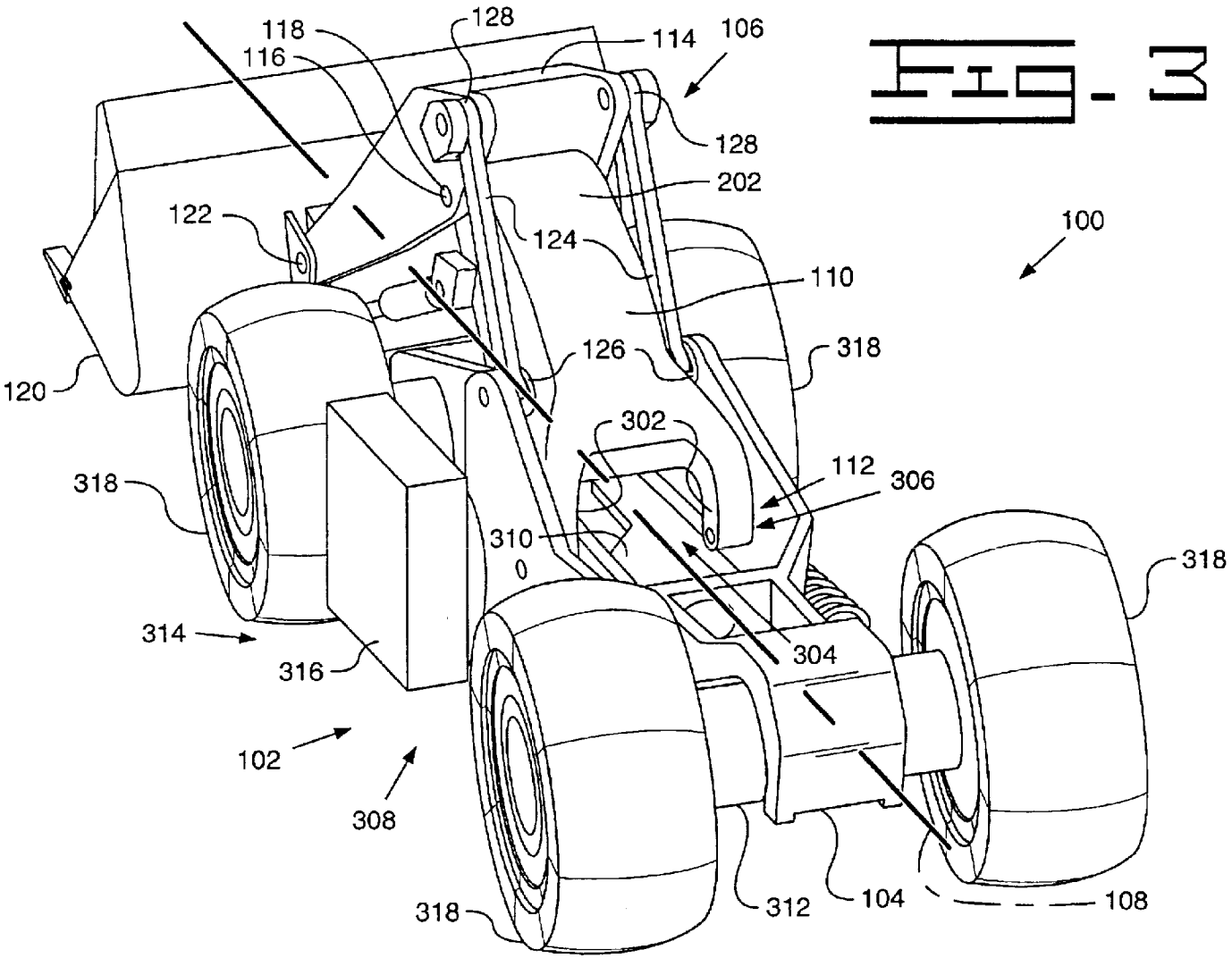
FIG. 3 is yet another view of the overshot loader.

Referring to the drawings, in particular FIGS. 1–3, the overshot loader 100 includes a set of ground engaging members 102, for example a set of tires 318. It is noted, however, that other types of ground engaging members 102 may be used as well, for example tracks or a track-tire combination. A frame 104 is attached to the set of ground engaging members 102.

A linkage assembly 106 is movably connected to the frame 104 and is located within a longitudinal center portion 108 of the frame 104. More specifically, the linkage assembly 106 is substantially centered with and parallel to the longitudinal center portion 108 of the frame 104.

The linkage assembly 106 includes a boom 110 having a first end 112 pivotally connected to the frame 104, a stick 114 having a first end 116 pivotally connected to a second end 118 of the boom 110, and a work implement 120 pivotally connected to a second end 122 of the stick. The linkage assembly 106 also includes at least one control link 124 having a first end 126 pivotally connected to the frame 104 and a second end 128 pivotally connected to the stick 114. For example, in the drawings, two control links 124, one located on each side of the boom, are shown.

The linkage assembly 106 also includes at least one work implement cylinder 406 having a first end 408 pivotally attached to the boom 110 and a second end 410 pivotally attached to the work implement 120. For example, two work implement cylinders 406 are shown, particularly in FIGS. 1 and 2. In the preferred embodiment, the second end 410 of the work implement cylinder 406 is extendable.

Figure 4A:
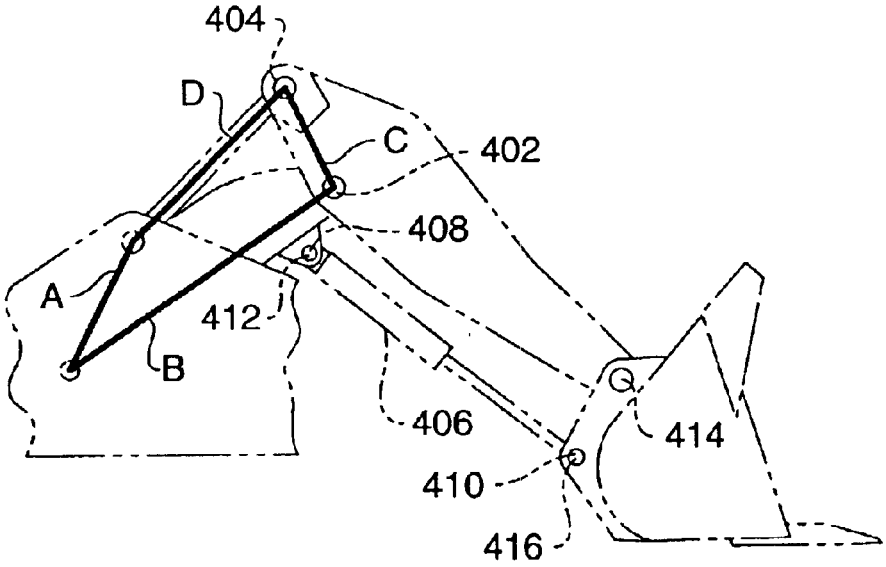
FIG. 4*a* is a diagrammatic illustration of a first four bar linkage of the overshot loader of the present invention.

The linkage assembly 106 is configured in a first four bar linkage, as shown in FIG. 4*a*. The frame 104 defines a ground link of the first four bar linkage, as shown by line A. The boom 110 defines a power link of the first four bar linkage, as shown by line B. A portion of the stick 114 from a boom-to-stick connection point 402 to a control link-to-stick connection point 404 defines a coupler link of the first four bar linkage, as shown by line C. The control link 124 defines a control link of the first four bar linkage, as shown by line D.

Figure 5:
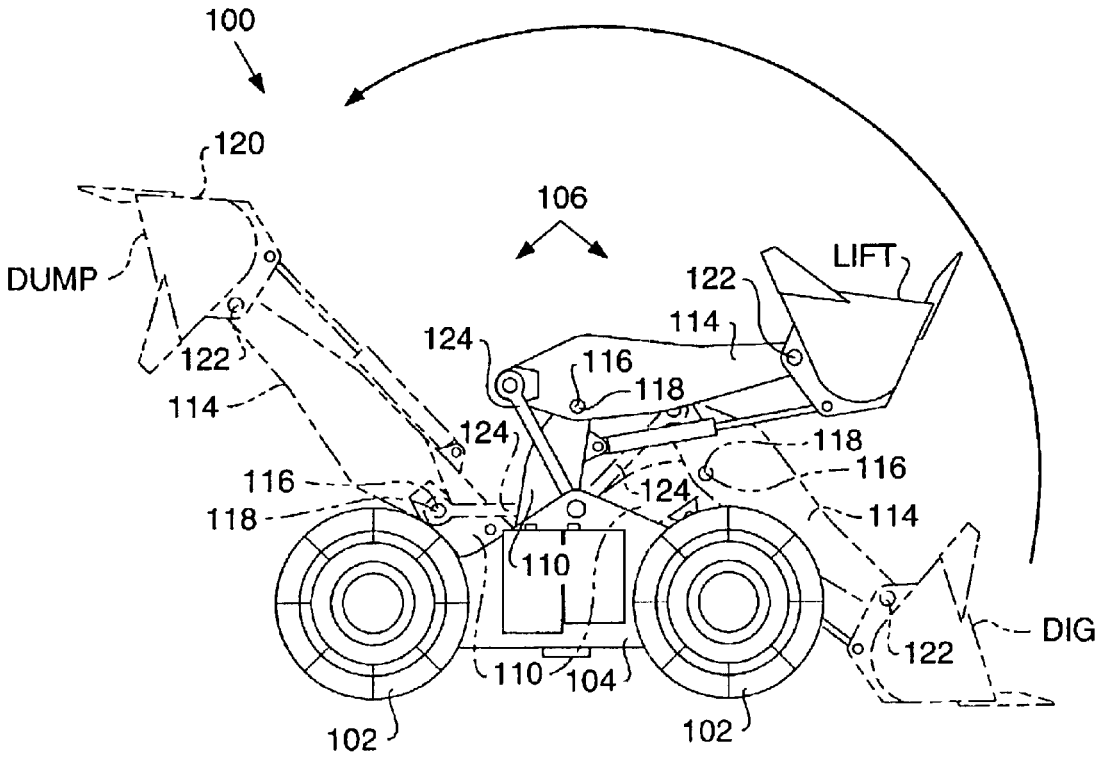
FIG. 5 is a diagrammatic illustration depicting several positions of a linkage assembly on the overshot loader.

Referring to FIG. 5, the first four bar linkage enables the linkage assembly 106 to lift vertically through a pile of material and then carry a load low over the top of the overshot loader 100, thus providing controllability, stability, and energy savings during a dig cycle.

Figure 4B:
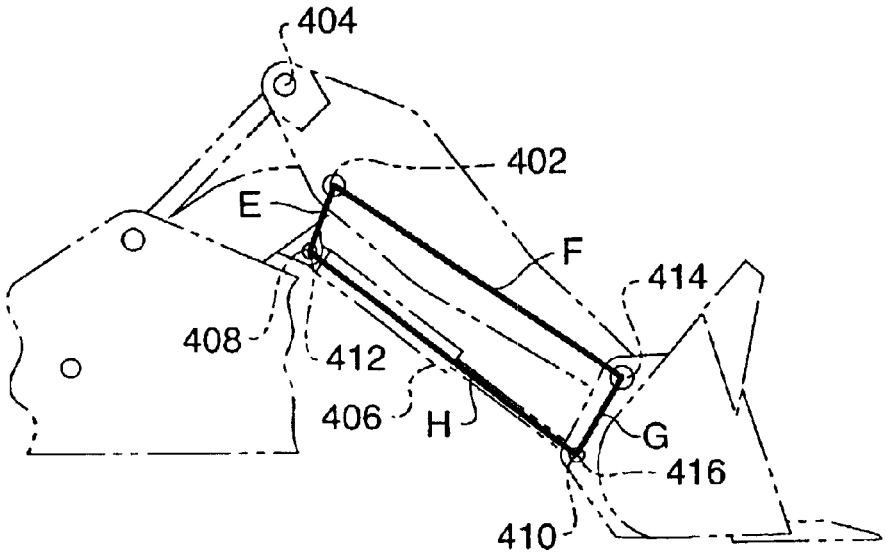
FIG. 4*b* is a diagrammatic illustration of a second four bar linkage of the overshot loader.

The linkage assembly 106 is also configured in a second four bar linkage, as shown in FIG. 4*b*. A portion of the boom 110 from a cylinder-to-boom connection point 412 defines a first link of the second four bar linkage, as shown by line E. The stick 114 defines a second link of the second four bar linkage, as shown by line F. A portion of the work implement 120 from an implement-to-stick connection point 414 to an implement-to-cylinder connection point 416 defines a third link of the second four bar linkage, as shown by line G. The work implement cylinder 406 defines a fourth link of the second four bar linkage, as shown by line H.

Referring once again to FIG. 5, the second four bar linkage provides for automatic uncurling of the work implement 120 as the linkage assembly 106 moves over the top of the overshot loader 100 from a dig position to a dump position. The uncurling is accomplished by the motion of the stick 114 and the boom 110 and the effect of this motion on the work implement cylinder 406, which is connected to the boom 110. The built-in uncurling motion keeps the load in the work implement 120 from spilling.

Figure 6A:
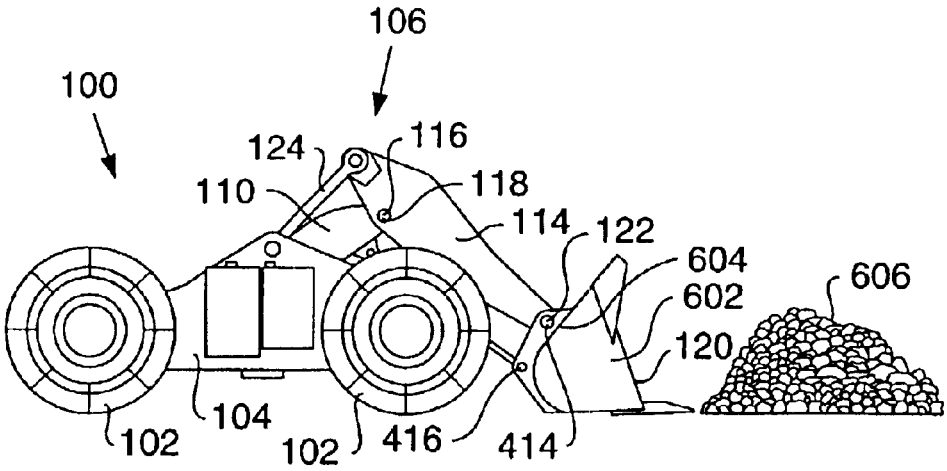
FIG. 6*a* is a diagrammatic illustration of an overshot loader in a dig position.

Preferably, the work implement 120 is a bucket 602. Referring to FIG. 6*a*, the bucket 602 includes an upper portion 604 defined by the linkage assembly 106 being located in a dig position; that is, the bucket 602 is located near the ground and about to approach a pile 606 for digging. The implement-to-stick connection point 414 is located on the upper portion 604 of the bucket 602. The implement-to-cylinder connection point 416 is located on the upper portion 604 of the bucket 602 at a point lower than the implement-to-stick connection point 414 when the linkage assembly 106 is located in the dig position. This configuration causes a curl action when the bucket 602 moves through a pile of material during the dig function, thus causing the bucket 602 to "scoop" through the pile and load material.

Referring to FIG. 3, the boom 110 includes a main portion 202 centered with and extending parallel to the longitudinal center portion 108 of the frame 104. In addition, the first end 112 of the boom 110 has a width greater then the width of the main portion 202 of the boom 110. Preferably, the first end 112 of the boom 110 includes two end portions 302 pivotally connected to the frame 104 and a hollow center portion 304. The two end portions 302 and the hollow center portion 304 define a forked end. The greater width of the first end 112 of the boom 110 provides a wider attachment to the frame 104 which helps compensate for lateral bucket forces and bucket corner loading. The hollow center portion 304 also helps accommodate for placement of an engine in the loader 100.

The overshot loader 100 also includes a prime mover 308 located within the frame 104 to provide power and mobility for the loader 100. The prime mover 308 includes an engine 310 and a drive train 312 drivably connected to the engine 310. The drive train 312 is configured to drivably engage the set of ground engaging members 102.

A heat exchanger 314 for removing heat generated by the engine 310 is preferably located on one side of the frame 104 parallel to the longitudinal center portion 108 of the frame 104. The side location of the heat exchanger 314 allows the overshot loader 100 to be designed with a minimum length to minimize the required lift height of a load. Although not shown, the heat exchanger 314 is surrounded by a shroud to reduce dust and debris from the ground engaging members 102. In the preferred embodiment, the heat exchanger 314 is a radiator 316.

Figure 7A:
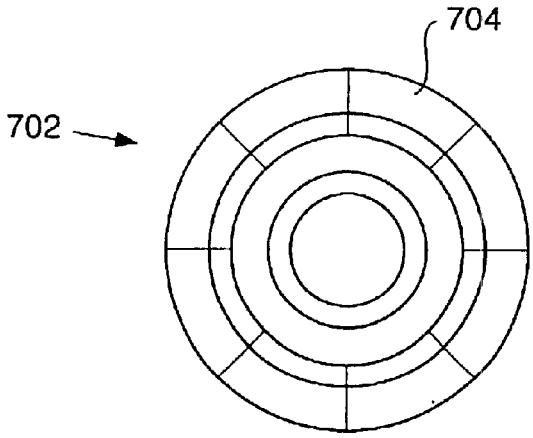
FIG. 7*a* is a diagrammatic illustration of a segmented tire.
Figure 7B:
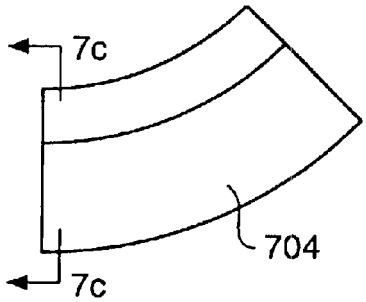
FIG. 7*b* is a diagrammatic illustration of a section of the segmented tire of FIG. 7*a*.
Figure 7C:
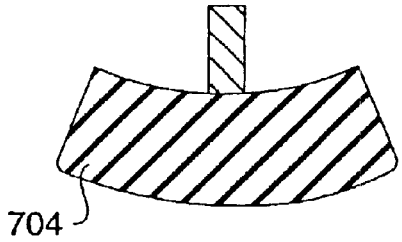
FIG. 7*c* is another view of the section of FIG. 7*b*.

The ground engaging members 102 preferably include a set of tires 318. The tires 308 may be pneumatic, air-filled tires as is commonly used in such machines. Alternatively, the tires 308 may be solid and non-pneumatic, as shown in FIG. 7*a*. Solid tires provide greater stability and do not go flat from punctures. However, solid tires create high frame loads. Thus, the frame 104 would be designed to accommodate solid tires if such tires were desired. FIGS. 7*b* and 7*c* illustrate segmented sections 704 of solid tires 702 which are assembled to a wheel (not shown) to create a complete tire. Segmented solid tires provide for easier shipping and individual replacement if a portion of a tire must be replaced.

INDUSTRIAL APPLICABILITY

Figure 6B:
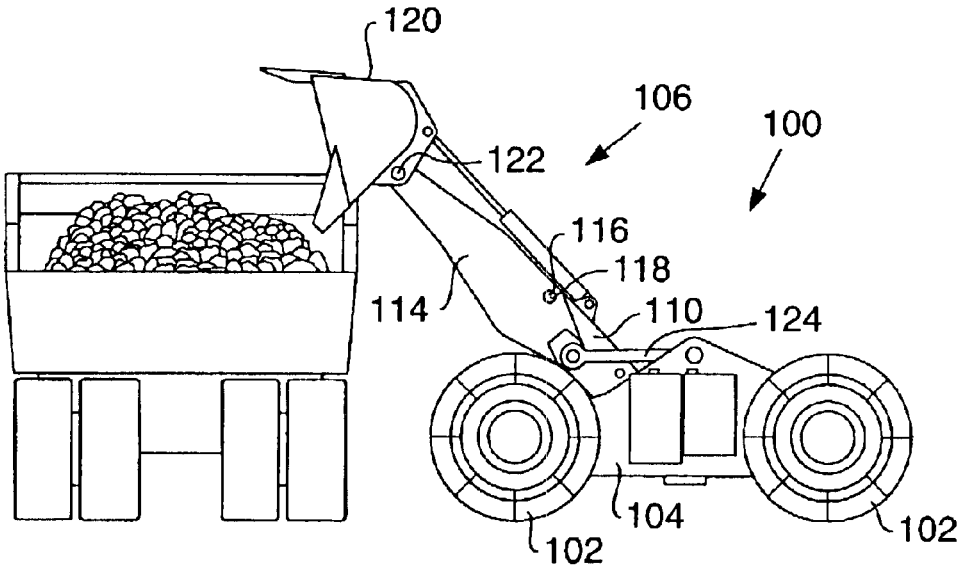
FIG. 6*b* is a diagrammatic illustration of an overshot loader in a dump position.

As an example of an application of the present invention, reference is made to FIGS. 6*a* and 6*b* and also to FIG. 5.

In FIG. 6*a*, the overshot loader 100 is shown in a dig position; that is, the bucket 602 is lowered to the ground as the loader 100 approaches a pile 606 of material. The dig position is also shown in FIG. 5 by the bucket labeled DIG.

Once the bucket 602 has entered the pile 606, the linkage assembly 106 lifts the bucket 602 with a load from the pile, as shown by the bucket labeled LIFT in FIG. 5.

The overshot loader 100 then carries the bucket of material over the top of the loader 100 to perform a dump operation, as shown in FIG. 6*b*. This position of the bucket 602 is also shown in FIG. 5 by the bucket labeled DUMP. After the dump is completed, the linkage assembly 106 then returns over the top of the loader 100 to the dig position to repeat the cycle.

The overshot loader 100 depicted in the drawings can complete an entire dig-dump cycle without turning around, thus saving time and increasing productivity and efficiency. Furthermore, the overshot loader 100 of the present invention is designed to minimize the work required during each dig-dump cycle, thus further increasing productivity.

Other aspects can be obtained from a study of the drawings, the disclosure, and the appended claims.

What is claimed is:

1. A loader having a dig end and a dump end opposite the dig end, comprising:

a set of ground engaging members;

a frame attached to the set of ground engaging members, the frame having a longitudinal direction from the dig end of the loader to the dump end of the loader; and a linkage assembly movably connected to and located at least partially within a longitudinal center portion of the frame and aligned with a transverse center of the frame, wherein the linkage assembly is configured to autonomously transport a material from the dig end of the loader to the dump end of the loader, while the orientation of the linkage assembly remains substantially aligned in the longitudinal direction and the linkage assembly includes:

a boom having a first end pivotally connected to the frame, the boom configured for pivotal movement in a single plane parallel to the longitudinal direction;

a stick having a first end pivotally connected to a second end of the boom;

a work implement pivotally connected to a second end of the stick; and at least one control link having a first end pivotally connected to the frame and a second end pivotally connected to the stick.

2. A loader, as set forth in claim 1, wherein the frame defines a ground link of a first four bar linkage, the boom defines a power link of the first four bar linkage, a portion of the stick from a boom-to-stick connection point to a control link-to-stick connection point defines a coupler link of the first four bar linkage, and the control link defines a control link of the first four bar linkage.

3. A loader, as set fourth in claim 1, wherein the linkage assembly further includes at least one work implement cylinder having a first end pivotally attached to the boom and a second end pivotally attached to the work implement.

4. A loader, as set fourth in claim 3, wherein the second end of the work implement cylinder is extendable.

5. A loader, as set fourth in claim 4, wherein a portion of the boom from a cylinder-to-boom connection point to the boom-to-stick connection point defines a first link of a second four bar linkage, the stick defines a second link of the second four bar linkage, a portion of the work implement from an implement-to-stick connection point to an implement-to-cylinder connection point defines a third link of the second four bar linkage, and the work implement cylinder defines a fourth link of the second four bar linkage.

6. A loader, as set fourth in claim 3, wherein the work implement is a bucket having an upper portion defined by the linkage assembly being located in a dig position.

7. A loader, as set forth in claim 6, wherein the implement-to-stick and implement-to-cylinder connection points are located on the upper portion of the bucket and the implement-to-cylinder connection point is at a point lower than the implement-to-stick connection point when the linkage assembly is located in the a dig position.

8. A loader, as set forth in claim 1, wherein the boom includes a main portion centered with and extending parallel to the longitudinal center portion of the frame, and wherein the first end of the boom has a width greater than the width of the main portion of the boom.

9. A loader, as set forth in claim 8, wherein the first end of the boom has two end portions pivotally connected to the frame and a hollow center portion, the two end portions and the center portion defining a forked end.

10. A loader, as set forth in claim 1, further including a prime mover located within the frame, the prime mover including:

an engine; and a drive train drivably connected to the engine, the drive train being further configured to drivably engage the set of ground engaging members.

11. A loader, as set forth in claim 10, further including a heat exchanger for removing heat generated by the engine, wherein the heat exchanger is located on one side of the frame parallel to the longitudinal center portion of the frame.

12. A loader, as set forth in claim 11, wherein the heat exchanger is a radiator.

13. A loader, as set forth in claim 1, wherein the set of ground engaging member includes a set of tires.

14. A loader, as set forth in claim 13, wherein each tire is a solid, non-pneumatic tire.

15. A linkage assembly for a loader having a frame, a dig end, and a dump end opposite the dig end, comprising:

a boom having a first end pivotally connected to a longitudinal center portion of the frame and aligned with a transverse center of the frame;

a stick having a first end pivotally connected to a second end of the boom; and a work implement pivotally connected to a second end of the stick, wherein the linkage assembly is configured to autonomously transport a material from the dig end of the loader to the dump end of the loader, while the orientation of the linkage assembly remains substantially aligned in a longitudinal direction relative to the frame.

16. A linkage assembly, as set forth in claim 15, wherein the first end of the boom has two end portions pivotally connected to the frame and a hollow center portion, the two end portions and the center portion defining a forked end.

17. A loader having a dig end and a dump end opposite the dig end, comprising:

a set of ground engaging members;

a frame attached to the set of ground engaging members, the frame having a longitudinal direction from the dig end of the loader to the dump end of the loader;

a boom having a first end pivotally connected to a longitudinal center portion of the frame and aligned with a transverse center of the frame;

a stick having a first end pivotally connected to a second end of the boom;

a work implement pivotally connected to a second end of the stick; and at least one control link having a first end pivotally connected to the frame and a second end pivotally connected to the stick;

wherein the frame defines a ground link of a first four bar linkage, the boom defines a power link of the first four bar linkage, a portion of the stick from a boom-to-stick connection point to a control link-to-stick connection point defines a coupler link of the first four bar linkage, and the control link defines a control link of the first four bar linkage; and wherein the linkage assembly is configured to autonomously transport a material from the dig end of the loader to the dump end of the loader, while the orientation of the linkage assembly remains substantially aligned in the longitudinal direction.

18. A loader, as set forth in claim 17, further including at least one work implement cylinder having a first end pivotally attached to the boom and a second end pivotally attached to the work implement, wherein the second end of the work implement cylinder is extendable.

19. A loader, as set forth in claim 18, wherein a portion of the boom from a cylinder-to-boom connection point to the boom-to-stick connection point defines a first link of a second four bar linkage, the stick defines a second link of the second four bar linkage, a portion of the work implement from an implement-to-stick connection point to an implement-to-cylinder connection point defines a third bar of the second four bar linkage, and the work implement cylinder defines a fourth bar of the second four bar linkage.

20. A loader, as set forth in claim 1, wherein the loader is remotely controlled.

21. A loader, as set forth in claim 1, wherein the linkage assembly automatically positions the work implement a minimum distance from a connection point between the linkage assembly and the frame generally mid-swing between a dig position and a dump position.

22. A loader, as set forth in claim 1, wherein the linkage assembly has a first outer connection surface configured to mate a first inner connection surface of the frame, and a second outer connection surface configured to mate a second outer connection surface of the frame, the second outer connection surface disposed on a side opposite the first outer connection surface.

23. A loader, as set forth in claim 1, wherein the boom is substantially perpendicularly oriented relative to the stick generally mid-swing between a dig position and a dump position.

24. A loader, as set forth in claim 1, wherein the stick is substantially parallel to a ground engaged by the set of ground engaging members generally mid-swing between a dig position and a dump position.

25. A loader, as set forth in claim 1, wherein the first end of the boom is connected to the frame at a point lower than an outer periphery of the set of ground engaging members relative to a ground engaged by the set of ground engaging members.

26. A loader, as set forth in claim 1, wherein the first end of the boom is located transversely inward of the set of ground engaging members relative to the longitudinal direction.

27. A loader, as set forth in claim 1, further including at least one cylinder having a first end operatively connected to the frame and a second end operatively connected to the boom, and the boom has a channel configured to receive the second end of the at least one cylinder.

28. A loader, as set forth in claim 10, wherein the prime mover is located below the linkage assembly relative to a ground engaged by the set of ground engaging members.

29. A linkage assembly, as set forth in claim 15, further including at least one control link having a first end pivotally connected to the frame and a second end pivotally connected to the stick, and the boom is configured for pivotal movement in a single plane parallel to the longitudinal center portion of the frame.

30. A linkage assembly, as set forth in claim 15, wherein the linkage assembly further includes at least one work implement cylinder having a first end pivotally attached to the boom and a second end pivotally attached to the work implement.

31. A linkage assembly, as set forth in claim 15, wherein the boom includes a main portion and the first end of the boom has a width greater than the width of the main portion.

32. A linkage assembly, as set forth in claim 15, wherein the linkage assembly has a first outer connection surface configured to mate a first inner connection surface of the frame, and a second outer connection surface configured to mate a second outer connection surface of the frame, the second outer connection surface disposed on a side opposite the first outer connection surface.

33. A linkage assembly, as set forth in claim 15, further including at least one cylinder having a first end operatively connected to the frame and a second end operatively connected to the boom, and the boom has a channel configured to receive the second end of the at least one cylinder.

* * * * *